US009877570B2

(12) United States Patent
Bergkvist

(10) Patent No.: US 9,877,570 B2
(45) Date of Patent: Jan. 30, 2018

(54) CARRYING SYSTEM

(71) Applicant: Coxa Carry AB, Ahus (SE)

(72) Inventor: Claes Bergkvist, Ahus (SE)

(73) Assignee: COXA CARRY AB (SE)

( * ) Notice: Subject to any disclaimer, the term of this patent is extended or adjusted under 35 U.S.C. 154(b) by 0 days.

(21) Appl. No.: 14/413,991

(22) PCT Filed: Jul. 11, 2013

(86) PCT No.: PCT/EP2013/064731
§ 371 (c)(1),
(2) Date: Jan. 9, 2015

(87) PCT Pub. No.: WO2014/009492
PCT Pub. Date: Jan. 16, 2014

(65) Prior Publication Data

US 2015/0173492 A1 Jun. 25, 2015

(30) Foreign Application Priority Data

Jul. 12, 2012 (SE) ..... 1250824

(51) Int. Cl.
*A45F 3/04* (2006.01)
*A41F 15/02* (2006.01)
(Continued)

(52) U.S. Cl.
CPC ..... *A45F 3/04* (2013.01); *A45F 3/12* (2013.01); *A45F 3/14* (2013.01); *A41F 15/02* (2013.01);
(Continued)

(58) Field of Classification Search
CPC ..... A45F 3/04; A41F 15/02; A44B 11/25
(Continued)

(56) References Cited

U.S. PATENT DOCUMENTS 268,932 A * 12/1882 Poirier ..... A42B 1/24 224/181
2,912,984 A * 11/1959 Jensen ..... A41C 3/02 2/263
(Continued)

FOREIGN PATENT DOCUMENTS

FR 2630897 A1 11/1989
WO WO-2004100707 A1 11/2004
(Continued)

OTHER PUBLICATIONS

Corresponding Chinese Application No. 201380037148.6, Office Action dated Dec. 10, 2015, 5 pages.

*Primary Examiner* — Justin Larson
(74) *Attorney, Agent, or Firm* — Fishman Stewart PLLC

(57) ABSTRACT

A carrying system comprising a load receptive unit for at least partly covering the back of a user, a first carrying strap extending between a first position of an upper section of said load receptive unit and a first position of a lower section of said load receptive unit, a second carrying strap extending between a second position of an upper section of said load receptive unit and a second position of a lower section of said load receptive unit, and a connecting device. The connecting device comprises a first portion arranged on the first carrying strap and a second portion arranged on the second carrying strap and releasably attachable to the first portion, wherein the first portion and the second portion of the connecting device are displaceably arranged along the extension of the first and second carrying strap. Also, a backpack and a tool belt comprising the carrying system and a method for attaching the carrying system is provided.

23 Claims, 8 Drawing Sheets

(51) Int. Cl.

| | |
|---|---|
| ***A44B 11/25*** | (2006.01) |
| ***A45F 3/12*** | (2006.01) |
| ***A45F 3/14*** | (2006.01) |
| *A45F 3/00* | (2006.01) |

(52) U.S. Cl.
CPC ..... *A44B 11/25* (2013.01); *A45F 2003/001* (2013.01); *A45F 2003/144* (2013.01); *A45F 2003/146* (2013.01)

(58) Field of Classification Search
USPC ..... 24/200, 616; D11/216
See application file for complete search history.

(56) References Cited

U.S. PATENT DOCUMENTS 3,165,803 A * 1/1965 Gaylord ..... A44B 11/2526 24/311
3,520,033 A * 7/1970 Usuda ..... A44B 11/2588 24/590.1
5,380,238 A * 1/1995 Crew-Gee ..... A41C 3/02 2/73
5,961,014 A * 10/1999 Knerr ..... A45F 3/04 224/153
5,964,642 A * 10/1999 Fildan ..... A41F 1/006 2/323
D420,620 S * 2/2000 Riley ..... D11/216
6,164,505 A * 12/2000 Holter ..... A45C 13/38 224/259
6,179,175 B1 * 1/2001 Painter ..... A45F 3/08 224/153
6,298,944 B1 10/2001 Forbes et al.
6,457,620 B1 * 10/2002 Batten ..... A63B 55/408 206/315.3
D479,151 S * 9/2003 Hamilton ..... D11/216
6,626,342 B1 * 9/2003 Gleason ..... A45F 3/08 224/633
6,793,556 B1 * 9/2004 Fildan ..... A41C 3/02 2/323
6,923,357 B2 8/2005 Smith
8,087,130 B2 * 1/2012 Chan ..... A44B 13/00 24/265 H
8,333,433 B2 * 12/2012 Friedman ..... B60N 2/2812 24/615
8,403,193 B2 * 3/2013 Chan ..... A45F 3/12 224/262
8,459,518 B2 * 6/2013 Demsky ..... A45F 3/047 224/576
8,464,920 B2 * 6/2013 Meyer ..... A45F 3/047 224/627
8,807,411 B2 * 8/2014 Meyer ..... A45F 3/04 224/627
8,827,766 B2 * 9/2014 Lin ..... A41F 1/006 2/326
8,974,005 B2 * 3/2015 Mason ..... B60N 2/2812 24/614
9,314,088 B2 * 4/2016 Lesch ..... A44B 11/2573
2003/0173390 A1 * 9/2003 Smith ..... A01K 97/06 224/604
2012/0045597 A1 2/2012 Ponce

FOREIGN PATENT DOCUMENTS

WO WO-2006020593 A1 2/2006
WO WO-2014009492 A1 1/2014

* cited by examiner

CARRYING SYSTEM

CROSS-REFERENCE TO RELATED APPLICATIONS

This application is a U.S. National phase based on PCT/EP2013/064731, filed on Jul. 11, 2013 entitled "CARRYING SYSTEM" which is based on Swedish Patent Application No. 1250824-8, filed on Jul. 12, 2012, which is hereby incorporated by reference in its entirely.

TECHNICAL FIELD

The present disclosure relates to a carrying system and especially a carrying system for backpacks and/or tool belts for craftsmen.

BACKGROUND

Solutions of carrying systems have been around and used for a long time but the existing backpacks have many drawbacks regarding e.g. its ergonomic features. Traditional backpacks do not consider different sizes and shapes when it comes to the user. An example may include a backpack with a number of straps crossing the shoulders, chest, stomach and hips of a user. This backpack, and many others, is characterized by difficulties when putting on and taking off the backpack. It may be of vital importance to be able to rapidly take off the backpack, e.g. in the case of mountain climbers and military personnel. Traditional backpacks are often equipped with complicated fastening means comprising of multiple fastening points which makes it difficult for the user to take the backpack off. Also, the fastening means are located so that most of the weight of the backpack it placed on the shoulders of the user and not distributed to other muscles of the body which may lead to e.g. great pain in the shoulders and neck.

An additional problem with traditional shoulder straps are that they often are too tight fitting at the sides of women's breasts. Also, typical backpacks with crossed carrying straps may press down on the breasts making it uncomfortable for women to wear.

It is an object to the present disclosure to provide an improved carrying system which solves or mitigates the above mentioned problems. This object is achieved by a technique defined in the appended independent claims; certain embodiments being set forth in the related dependent claims.

These and other objects as well as advantages, which will be obvious from the following description of the present disclosure, are achieved by a carrying system according to the independent claims.

A carrying system is achieved which comprises a load receptive unit for at least partly covering the back of a user, a first carrying strap extending between a first position of an upper section of the load receptive unit and a first position of a lower section of the load receptive unit, and a second carrying strap extending between a second position of an upper section of the load receptive unit and a second position of a lower section of the load receptive unit. The carrying system further comprises a connecting device, which comprises a first portion arranged on the first carrying strap and a second portion arranged on the second carrying strap and releasably attachable to the first portion. The first portion and the second portion of the connecting device are displaceably arranged along the extension of the first and second carrying strap. An advantageous feature of this carrying system may be that the connecting device which is freely displaceable along the carrying straps which means that every user can adjust the carrying straps, connecting device and load of e.g. the backpack, depending on his/her own needs.

In an embodiment the carrying system further comprises a first cover arranged at least partly around the first carrying strap and located between the first position of the upper section of the load receptive unit and the first portion of the connecting device, and a second cover arranged at least partly around the second carrying strap and located between the second portion of the upper section of the load receptive unit and the second portion of the connecting device. The first and second cover may further be made of a soft and flexible material so that they contribute to a comfortable fit on the shoulders and chest of the user. The covers also provide a protection to the carrying straps.

In an embodiment the first and second cover are made of a soft and flexible material which may be advantageous since it provides a soft contact between the covers and the shoulder and chest of the carrying user.

In an embodiment the first portion and second portion of the connecting device each comprises at least one stopping device. This may be advantageous since the stopping devices prevent the connecting device from moving along the carrying straps and end up at undesired position on the body of the carrying user.

In yet another embodiment the carrying system comprises a first stopping device arranged on the first carrying strap. This may be advantageous since the stopping device helps the connecting device to stay in a desired location which may be anywhere along the length of the strap.

In another embodiment the carrying system comprises a first and second stopping device arranged on the first and second carrying strap which helps the connecting device to stay in a desired position. Also, if the load applied the carrying system is heavy it is a preferred to provide at least one stopping device in each portion of the connecting device.

In an embodiment the carrying system further comprises a third stopping device arranged on the first carrying strap below the first portion of the connecting device and/or a fourth stopping device arranged on the second carrying strap below the second portion of the connecting device. It may be advantageous to arrange stopping devices below the connecting device so that the user easy can find the two portions of the connecting device when putting on the carrying system, i.e. the portions are prevented from moving outside of a length of the straps defined by the stopping devices.

In an embodiment the carrying system may further comprise a first tightening device arranged on the first carrying strap, between the first portion of the connecting device and the first position of the lower section of the load receptive unit and a second tightening device arranged on the second carrying strap, between the second portion of the connecting device and the second portion of the lower section of the load receptive unit. It may be an advantageous feature to provide the tightening devices since they bring the load receptive unit closer to the back of the user when pulled in. This contributes to a better distribution of the load applied on the carrying system and the user.

In an alternative embodiment the first and second carrying straps are each made in one piece. This makes the carrying system easier to handle when putting it on the user and connecting the two portions of the connecting device.

In an embodiment the first and second portion of the connecting device is connected to each other by means of a connector or a combination of connectors taken from a group comprising: magnets, hook-and-loop fastening strip, key hole fasteners, hook and loop fasteners, cuff link fastening and snap fastener. It is a preferred embodiment of the present disclosure to provide a connecting device which is easy and fast to attach and detach if the user need to get the carrying system off quickly, e.g. if the user get stuck. Depending on the application of the carrying system different connecting devices may be used for optimal comfort and security.

Another object of the present disclosure is to provide a backpack comprising a carrying system described above. The backpack may then be provided with the advantageous features of the carrying system. It is also possible to customize the carrying system depending on the size, shape and possible load of the backpack.

Yet another object of the present disclosure is to provide a tool belt for a craftsman comprising a carrying system, also with the advantageous features of the carrying system.

BRIEF DESCRIPTION OF THE DRAWINGS

Embodiments of the present disclosure will be described in the following references being made to the appended drawings, wherein.

DESCRIPTION OF EMBODIMENTS

Figure 1:
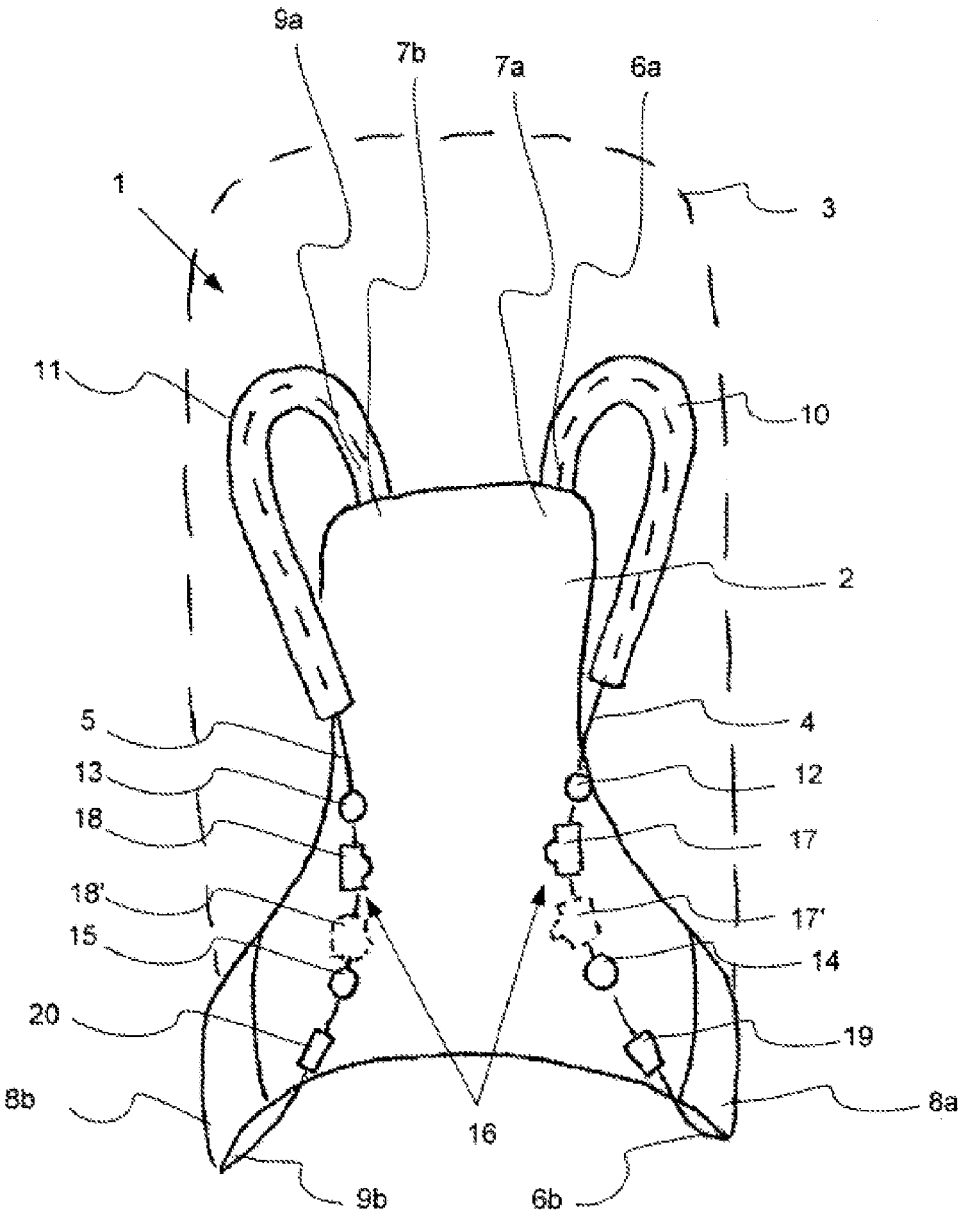
FIG. 1 shows a carrying system according to a first embodiment in an unlocked state.

FIG. 1 shows a carrying system 1 according to a first embodiment in an unlocked state. The carrying system 1 according to the present disclosure is defined by a system which may carry a load and applied on a person, e.g. a packed backpack or a tool belt. The carrying system 1 comprises a load receptive unit 2 connected to a storage sack 3, a first carrying strap 4 and a second carrying strap 5. The first carrying strap 4 is attached with its one end 6*a* to a first position of the upper section 7*a* of the load receptive unit 2 and with its other end 6*b* to a first position of the lower section 8*a* of the load receptive unit 2. The second carrying strap 5 is attached with its one end 9*a* to a second position of the upper section 7*b* of the load receptive unit 2 and with its other end 9*b* to a second position of the lower section 8*b* of the load receptive unit 2.

The carrying system 1 further comprises a first cover 10 which in this embodiment is a tube-like element enclosing parts of the first carrying strap 4. FIG. 1 shows a first cover 10 that extends from the first position of the upper section 7*a* along the extension of the first carrying strap 4. The carrying system 1 also includes a second cover 11, identical to the first cover 10 but arranged on the second carrying strap 5 from the second position of the upper section 7*b*. Both covers 10, 11 are, each by one end, in this first embodiment, attached to the first and second position of the upper section 7*a*, 7*b*, respectively but this feature is optional. The first and second cover 10, 11 may be of any size and shape and moveable along the first and second carrying strap 4, 5 so that the user may adjust it to fit his/her needs and body type. They may also be made of a soft and flexible material or a combination of materials, so that the carrying system feels gentle against the shoulders, neck and chest of the user.

In an alternative embodiment the first and second cover may each include a formable and/or flexible inner portion (not shown). The inner portion may be formable such as to correspond to the shape and size of the shoulder and chest of the user. The inner portion may also be configured to retain a certain shape after the user takes the carrying system off of his/her shoulders so that the covers have the same shape as the last time the carrying system was carried. If another user then is using the carrying system, with a different shoulder and chest shape and size the covers may be adjusted to fit the new user and then retain that new form.

It may be preferred to have detachable covers which are washable for keeping them clean and fresh. During the use of such carrying systems dirt and sweat is absorbed by the part closest to the body of the user, in this case it may be the covers. It is then desired to be able to clean them and keep them fresh so that they do not need to be exchanged. The material of the covers then may be a washable material which is able to retain its abilities, e.g. softness and flexibility, after they have been washed several times.

Below the first cover 10 on the first carrying strap 4 a first stopping device 12 is arranged. Also, below the second cover 11, on the second carrying strap 5, a second stopping device 13 is arranged, in the same way as the first stopping device 12 is. Further down on the first and second carrying strap 4, 5 a third stopping device 14 and a fourth stopping device 15 may also be arranged, but this is an optional feature. All the stopping devices 12, 13, 14, 15 are manually displaceable along the two carrying straps 4, 5 in such a way that the user easily by hand may be able to place the stopping devices 12, 13, 14, 15 in a preferred position. The purpose of the stopping device 12, 13, 14, 15 is to adjust the position of a connecting device 16 (better shown in FIGS. 5-8) and stop it from moving along the first and second carrying strap 4, 5. The user may then adjust the position of the connecting device 16 so that the connecting device 16 is located around the stomach area and stays there. The position of the connecting device 16 depends on the size and shape of the user and it is a preferred feature of this embodiment to provide a stopping device and connecting device that is easy to handle for users of all ages and sizes.

Between the first stopping device 12 and the third stopping device 14 on the first carrying strap 4 is a first portion 17 of the connecting device 16 arranged. Same goes for a second portion 18 of the connecting device 16 which is arranged between the second stopping device 13 and the fourth stopping device 15 on the second carrying strap 5. The first portion 17 and the second portion 18 of the connecting device are configured to interconnect with each other so that the first and second carrying strap 4, 5 are brought closer together and kept in place. Examples of preferred connecting devices 16 are shown in FIGS. 5-8. Both the first and second portion 17, 18 of the connecting device 16 are displaceable along the first and second carrying strap 4, 5 so that the user may adjust the position of the connecting device 16 when fastening and locking the carrying system 1 onto his/her back and shoulder. In FIG. 1 a dotted example of another position of the first and second portion 17', 18' of the connecting device 16 is shown. The first and the second carrying strap 4, 5 may either run through the first and the second portion 17, 18 of the connecting device 16 or through a type of a loop (not shown) on one outer side of the first and second portion 17, 18. The loop allows for the first and second carrying strap 4, 5 to run through it on the outside of the first and second portion 17, 18 of the connecting device 16.

Closest to the first and second position of the lower portion 8*a*, 8*b* a first tightening device 19 is arranged on the first carrying strap 4 and a second tightening device 20 is arranged on the second carrying strap 5. The purpose of the first and second tightening device 19, 20 may be so that, when the first and second portion 17, 18 of the connecting device 16 are connected to each other, the user may pull the first and second tightening device 19, 20 to tighten the first and second carrying strap 4, 5 so that the load receptive unit 2 and carrying system 1 closely surround the back of the user. This may be a preferred ergonomic feature since the weight of the carrying system 1 then is distributed to not only the shoulders of the user but also to his/her back, stomach, hip and legs. In an alternative embodiment tightening means (not shown) may be integrated in the stopping devices 12, 13, 14, 15 or in the connecting device 16 for tightening the straps as the carrying system is placed on a user for better comfort and load distribution.

The first and second carrying strap 4, 5 are preferably solid, thin straps which easily may be threaded through the elements arranged on the first and second carrying strap. The first and second carrying straps may of course in other embodiments have a different size or shape. The thin straps may also be referred to as ropes which may in different embodiment have varying thickness.

Figure 2:
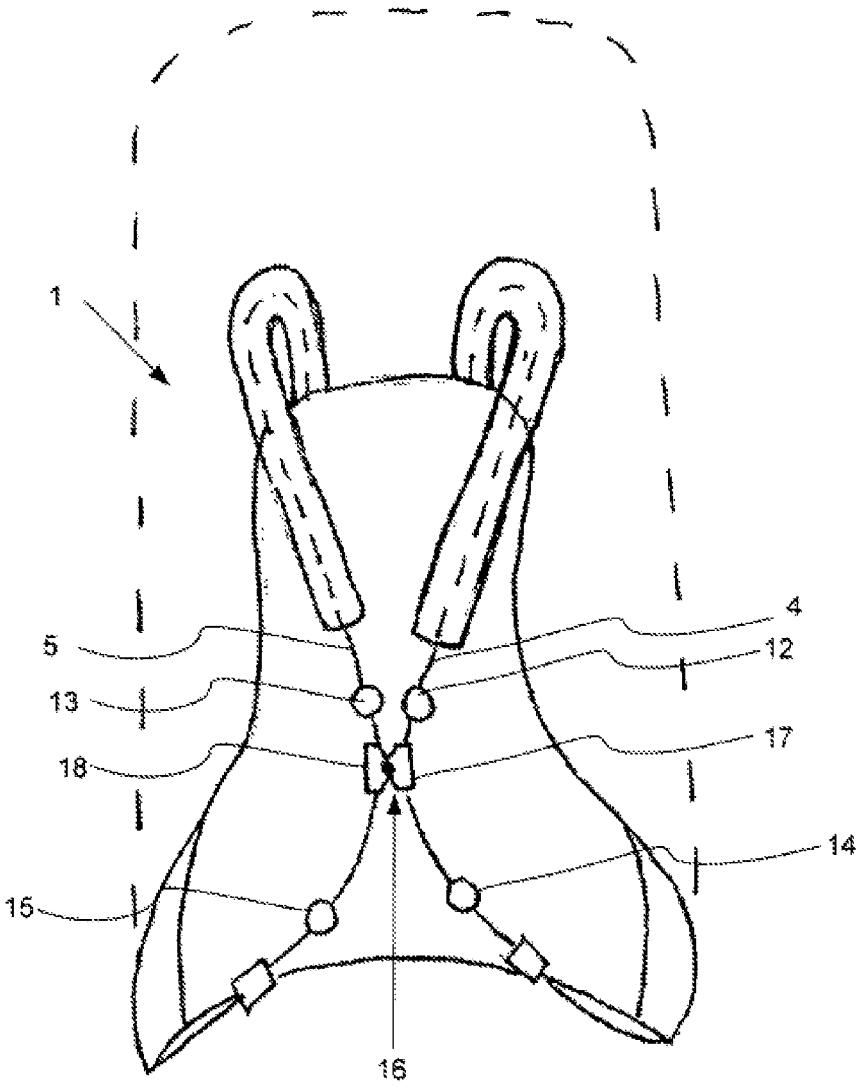
FIG. 2 shows the carrying system in FIG. 1 in a locked state.

FIG. 2 shows the carrying system 1 in FIG. 1 but in a locked state where the first and second portion 17, 18 of the connecting device 16 are connected to each other so that the first and second carrying strap 4, 5 are brought closely together. The first and second stopping device 12, 13 prevents the connecting device 16 from moving up the first and second carrying strap 4, 5 and the third and fourth stopping device 14, 15 prevents the connecting device 16 from moving down the same carrying straps 4, 5. The four stopping devices 12, 13, 14, 15 may be placed closer together to provide an even shorter length for the connecting device 16 to move within. The number of stopping devices 12, 13, 14, 15 is optional but a preferred embodiment comprises at least two stopping devices.

Figure 3:
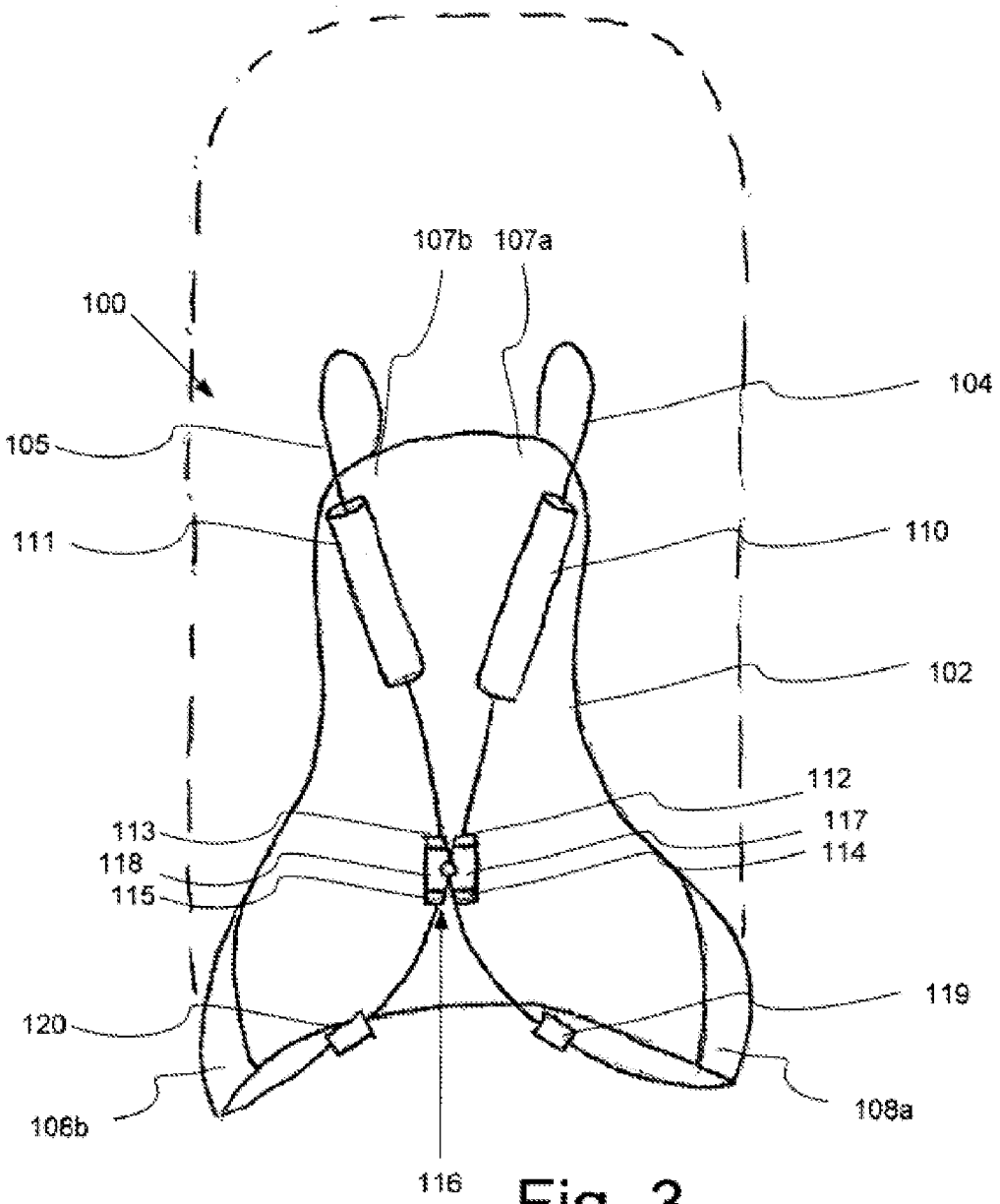
FIG. 3 shows a carrying system according to a second embodiment in a locked state.

FIG. 3 shows a carrying system 100 according to a second embodiment in a locked position, wherein the carrying system 100 comprises a load receptive unit 102, a first carrying strap 104, a second carrying strap 105, a first tightening device 119 and a second tightening device 120, similar to the above described units shown in FIGS. 1 and 2.

The carrying system 100 according to the second embodiment further comprises two slightly different covers, the first cover 110 which is arranged on the first carrying strap 104 and the second cover 111 which is arranged on the second carrying strap 105. The first and second cover 110, 111 have the shape of a tube and are displaceable along the extension of the first and second carrying strap 104, 105. The first and second cover 100, 111 may be of any size and length and removable, by means of fastening means (not shown), so that the user may adapt the carrying system 100 after his/her own needs. The fastening means for attaching and detaching the first and second cover 100, 111 may consist of e.g. a hook-and-loop fastening strip, at least one snap fastener or any other suitable fastening means. This type of cover 100, 111 may also, as in previous embodiments, be detachable and washable to keep it clean and fresh.

Further, the carrying system 100, shown in FIG. 3, comprises a connecting device 116 (shown in FIGS. 5-8) for connecting the first and second carrying strap 104, 105. The connecting device 116 includes a first portion 117 and a second portion 118 of the connecting device 116 wherein both the first portion 117 and the second portion 118 each include at least one stopping device 112, 113, 114, 115 so that the user may secure the connecting device 116 from moving up and down the first and second carrying strap 4, 5 while carrying the carrying system 1. One stopping devices 112, 113 may be integrated and located in the upper part of each first and second portion 117, 118 of the connecting device 116. Optionally, one more stopping device 114, 115 may be integrated and located in the lower part of each first and second portion 117, 118. The stopping device 112, 113, 114, 115 may be manually handled by the user so that the connecting device is placed in a position preferred by the user.

Figure 4:
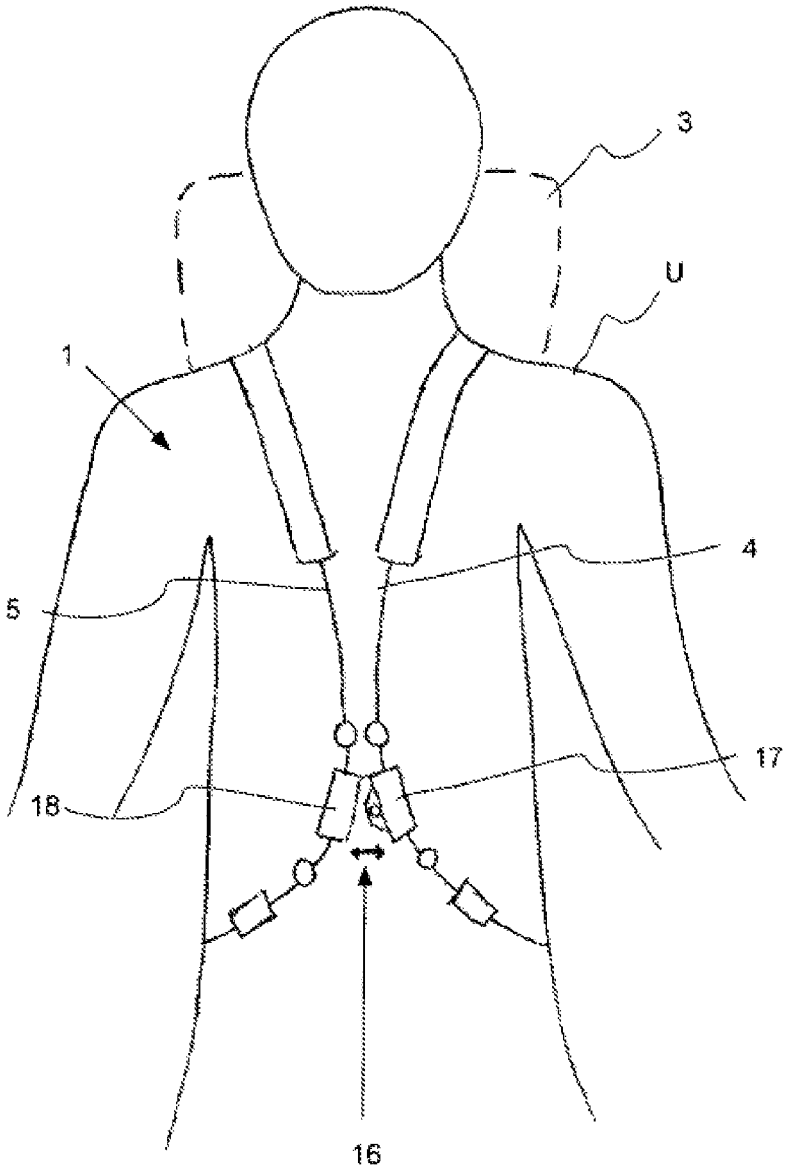
FIG. 4 shows the carrying system in FIG. 1 on a user.

FIG. 4 shows the carrying system 1 according the first embodiment, shown in FIGS. 1 and 2, placed on a user U. The design of the carrying system 1 provides a comfortable fit especially for women since the first and second carrying strap 4, 5 extends from the back of the user U, up and over the shoulders, close to the neck and then straight down, close to the center axis C of the user U. This means that the heavy load of the storage sack 3 is not applied directly on top of the breasts which otherwise may cause an uncomfortable fit for especially women.

FIG. 4 also shows the execution of connecting the first portion 17 to the second portion 18 of the connecting device 16 where the two portions 17, 18 are put together and connected by means of a connection which will be described in FIGS. 5-8. The user may adjust the position of the connecting device 16 as her/she wished and a preferred position is on the stomach of the user U. This may be an advantageous feature, in comparison with the earlier described prior art, since the weight load of the carrying system 1 then is moved down to the stomach and legs and closer to the neck and spine, releasing the shoulders of the user U from at least a part of the load. Due to the low location of the connecting device 16 the storage sack 3 may be arranged higher up on the back of the user U which also contributes to the release of load from his/her shoulders.

The design of the carrying system 1 also contributes to a better flexibility in the arms and shoulders of the user U since the carrying straps 4, 5 are not applied around the area of his/her bend of the arm.

FIGS. 5-8 show a number of alternative embodiments of the connecting device 16, 116. An advantageous feature of the connecting device 16, 116 may be for it to be a "quick-release" device so that if a user gets stuck with his/her carrying system/backpack, it should be easy and quick to release it from the body of the user U.

Figure 5A:
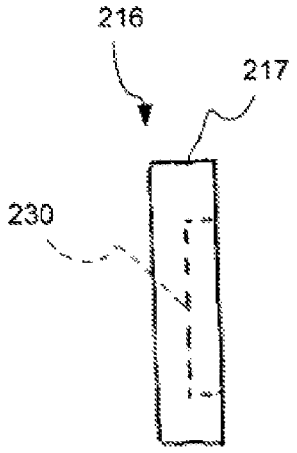
FIGS. 5*a-d* show a connecting device according to a first embodiment.
Figure 5B:
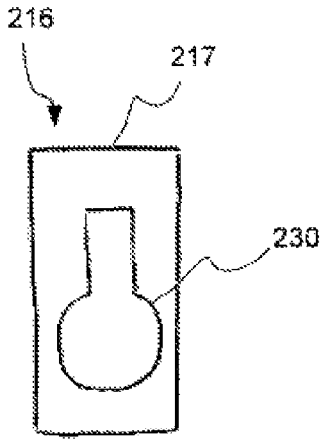

FIG. 5*a* shows a front view of a first portion 217 of a connecting device 216 according to a first embodiment and FIG. 5*b* shows a side view of the same first portion 217 wherein the first portion 217 includes an opening 230 which has the shape of an up-side-down key hole. FIG. 5*c* shows a side view of a second portion 218 of the connecting device 216 wherein the second portion includes a protrusion 231 and FIG. 5*d* shows a front view of the second portion 218.

Figure 5D:
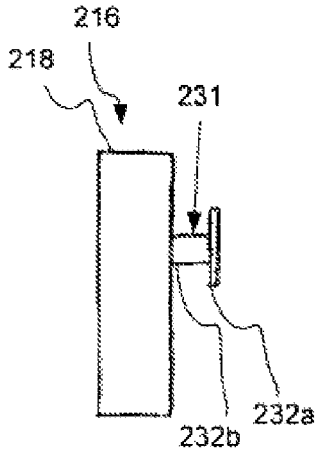
Figure 5C:
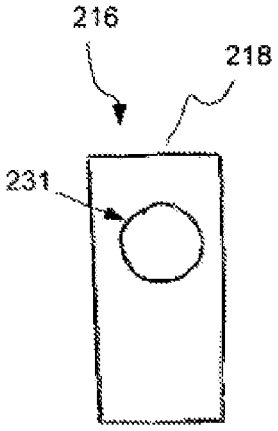

FIG. 5*d* also shows that the protrusion 231 consists of two parts wherein the first part 232*a* corresponds to the hole of the lower section of the opening 231 and the second part 232*b* corresponds to the hole of the upper section of the opening 213. To connect the first portion 217 and the second portion 218 of the connecting device 216, the first part 232*a* of the protrusion 231 is inserted into the hole of the lower section of the opening 230 and then push the protrusion 231 up so that the second part 232*b* runs in the upper section of the opening 230 and locks the first part 232*a* to escape from the first portion 217 of the connecting device 216.

Figure 6A:
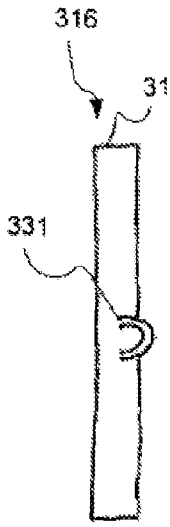
FIGS. 6*a-b* show a connecting device according to a second embodiment.
Figure 6B:
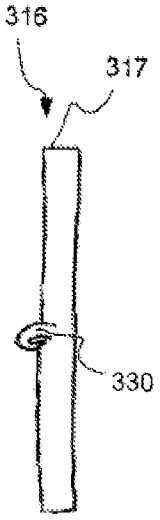

FIG. 6*a* and FIG. 6*b* show a front view of a connecting device 316 according to a second embodiment where a first portion 317 includes a hook 330 and a second portion 318 includes a loop 331 wherein the hook 330 and loop 331 may be connected to each other.

Figure 7A:
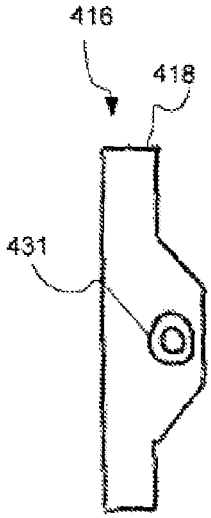
FIGS. 7*a-b* show a connecting device according to a third embodiment.
Figure 7B:
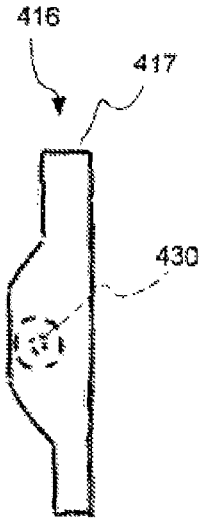

FIG. 7*a* and FIG. 7*b* show a front view of a connecting device 416 according to a third embodiment, wherein the connecting device 416 consists of a snap fastener 430, 431. The snap fastener 430, 431 may be replaced by e.g. magnets (not shown), a hook-and-loop fastening strip (not shown) or any other suitable connecting device.

Figure 8A:
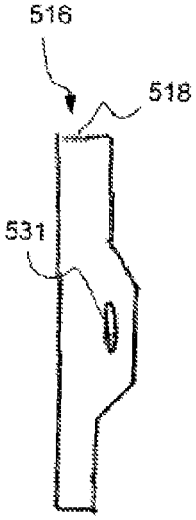
FIGS. 8*a-c* show a connecting device according to a fourth embodiment.
Figure 8B:
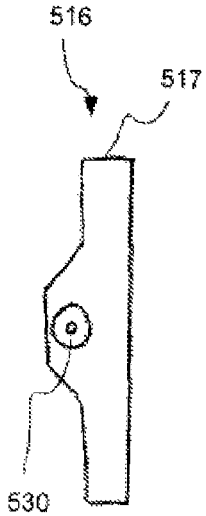
Figure 8C:
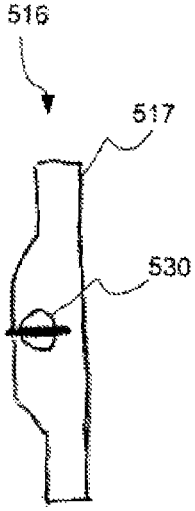
Figure 9A:
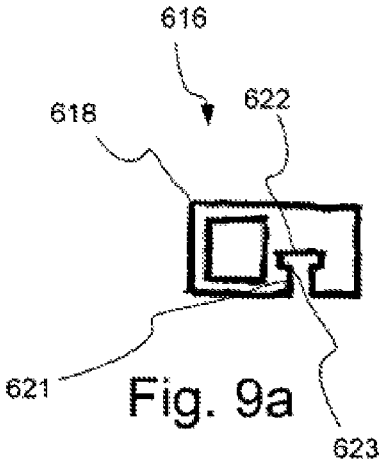
FIGS. 9*a-d* show a connecting device according to a fifth embodiment.
Figure 9B:
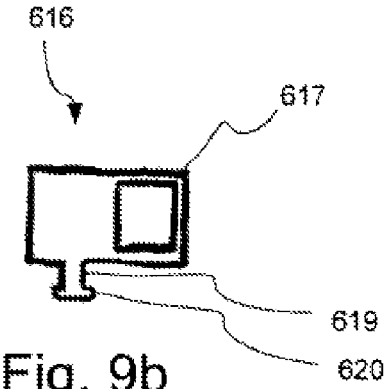
Figure 9C:
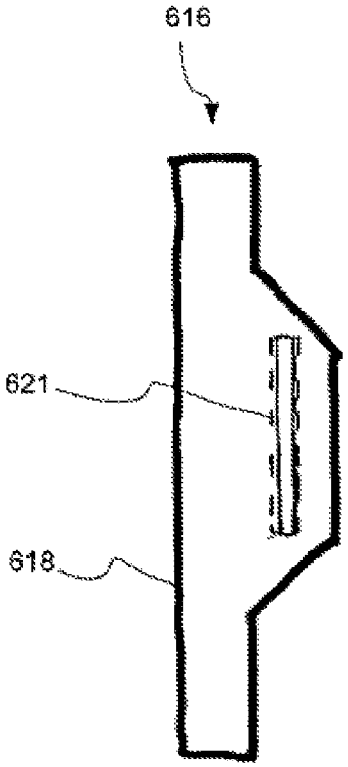
Figure 9D:
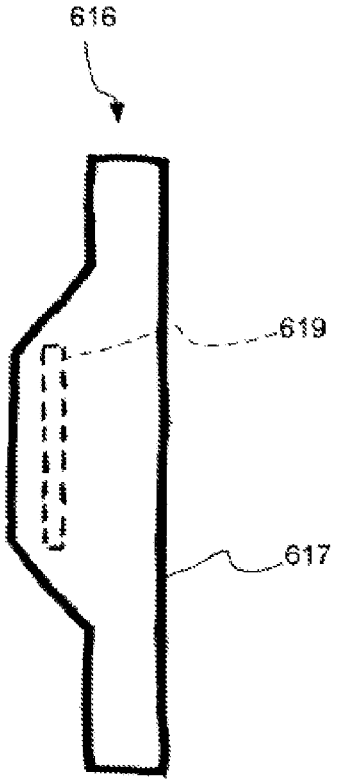

FIGS. 8*a*-8*c* show a front view of a connecting device 516 according to a fourth embodiment, wherein the connecting device 516 consists of a cuff link fastener 530, 531. FIG. 8*b* and FIG. 8*c* shows the same feature but in different states, where FIG. 8*b* shows an open state and FIG. 8*c* shows a locked state.

FIGS. 9*a*-*d* illustrate another embodiment of a connecting device 616 comprising a sliding system with a male portion 617 and a female portion 618. The male portion comprises at least one protrusion 619 extending perpendicular from one surface of the male portion 617. Preferably, the protrusion 619 has an edge portion 620 that is larger than the rest of the extension of the protrusion 619. The protrusion is preferably one elongated protrusion extending in the longitudinal extension of the male portion 617 but may in another embodiment comprise several protrusions (not shown) arranged after or next to each other. The female portion 618 on the other hand includes one or several recesses 621 which locations correspond to the locations of the one or more protrusion 619. The recess 621 may be an elongated recess comprising a bottom portion 622 having an edge 623. The edge 623 is arranged to grab hold of the edge portion 620 of the protrusion 619 when the male portion 617 slides into the female portion 618 creating a locking which does not allow any movement perpendicular to the extension of the protrusion 619 and the recess 621.

Figure 10A:
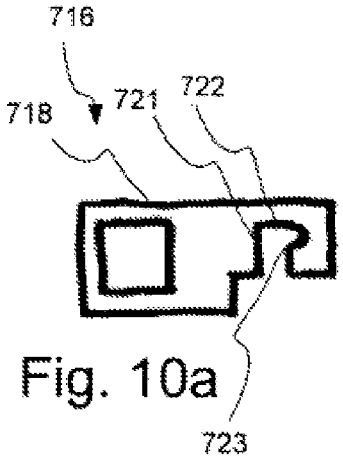
FIGS. 10*a-d* show a connecting device according to a sixth embodiment.
Figure 10B:
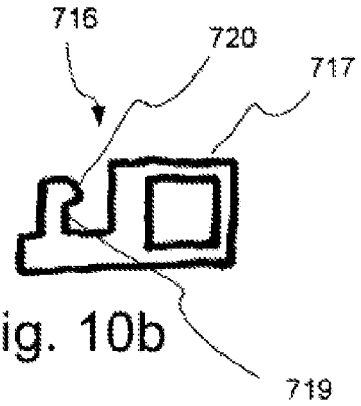
Figure 10C:
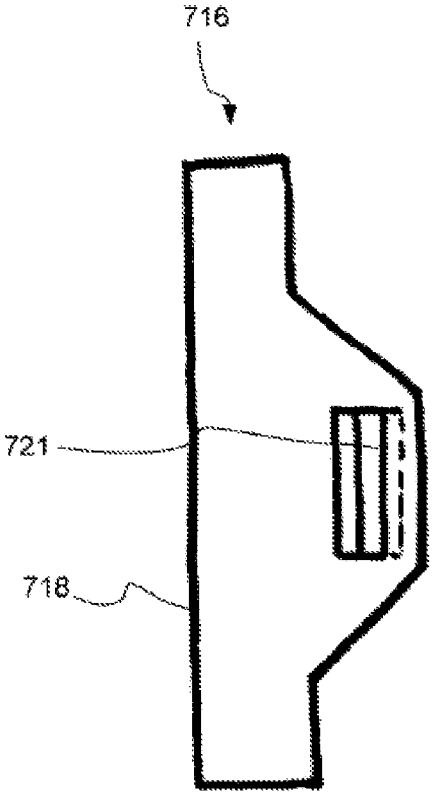
Figure 10D:
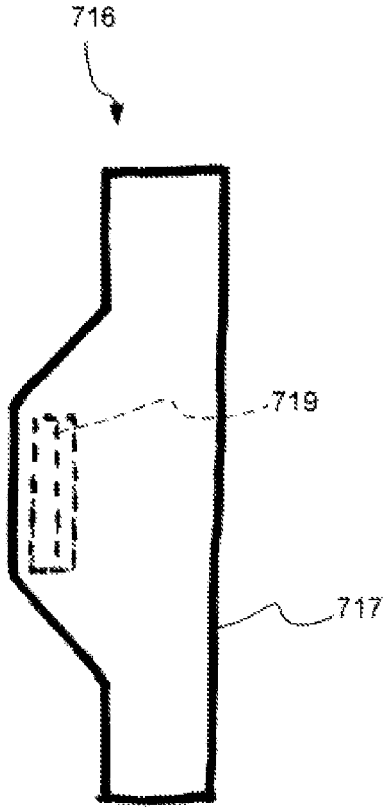

FIGS. 10*a*-*b* illustrate a further embodiment of a connecting device 716 being provided with a snap system with a male portion 717 and a female portion 718. The male portion comprises at least one protrusion 719 extending perpendicular from one surface of the male portion 717. Preferably, the protrusion 719 has an edge portion 720 that is larger than the rest of the extension of the protrusion 719. The protrusion is preferably one elongated protrusion extending in the longitudinal extension of the male portion 717 but may in another embodiment comprise several protrusions (not shown) arranged after or next to each other. The female portion 718 on the other hand includes one or several recesses 721 which locations correspond to the locations of the one or more protrusion 719. In this case the recess 721 is one elongated recess comprising a bottom portion 722 with an edge 723. The edge 723 is arranged to grab hold of the edge portion 720 of the protrusion 719 when the male portion 717 is pushed into the female portion 718 creating a snap locking which does not allow any movement perpendicular to the extension of the protrusion 719 and the recess 721.

Other suitable connecting devices may of course be used to achieve the advantageous features of the present disclosure.

The carrying system as described in view of the embodiments herein may be used in all kinds of applications, such as working cloths, tool belts, sports equipment, professional gadgets, protective equipment or the like, and not just for backpacks.

Although the present disclosure has been described above with reference to specific embodiments, it is not intended to be limited to the specific form set forth herein. Rather, the invention is limited only by the accompanying claims and, other embodiments than the specific above are equally possible within the scope of these appended claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A carrying system for carrying a load, comprising:

a load receptive unit for at least partly covering the back of a user;

a first carrying strap extending between a first position of an upper section of said load receptive unit; and a first position of a lower section of said load receptive unit;

a second carrying strap extending between a second position of an upper section of said load receptive unit; and a second position of a lower section of said load receptive unit;

a connecting device, wherein the connecting device comprises a first portion with a connector opening and a first passage about a first passage axis arranged along a first strap axis of the first carrying strap, and a second portion with a connector protrusion and a second passage about a second passage axis arranged along a second strap axis of the second carrying strap, the connector protrusion of the second portion being releasably attachable to the connector opening of the first portion, wherein a first part of the connector protrusion is inserted into a lower portion of the connector opening and a second part of the connector protrusion is pushed substantially parallel to the first passage axis and upwards with respect to an upper portion of the opening to lock the first part of the connector protrusion relative to the first portion of the connecting device;

wherein the first and second passage axes are adjustably arranged along and substantially parallel to the respective first and second strap axes, and wherein the first portion and the second portion of the connecting device are configured to interconnect with each other such that the first and second carrying straps are directly connected to each other; and a first tightening device is arranged on the first carrying strap and a second tightening device is arranged on the second carrying strap, wherein tightening of the tightening devices transfers the weight of the carrying system to the back, hips and legs of the user by shifting the position of the connecting device downwards.

2. The carrying system according to claim 1, further comprising a first cover arranged at least partly around the first carrying strap and located between the first position of the upper section of the load receptive unit and the first portion of the connecting device and a second cover arranged at least partly around the second carrying strap and located between the second portion of the upper section of the load receptive unit and the second portion of the connecting device.

3. The carrying system according to claim 2, wherein the first and second covers are made of a soft and flexible material.

4. The carrying system according to claim 1, wherein the first portion of the connecting device comprises at least one stopping device.

5. The carrying system according to claim 1, wherein the first portion and the second portion of the connecting device each comprises at least one stopping device.

6. The carrying system according to claim 1, further comprising a first stopping device arranged on the first carrying strap above the first portion of the connecting device to limit movement up the first carrying strap.

7. The carrying system according to claim 1, further comprising a first stopping device located between a first cover and the first portion of the connecting device.

8. The carrying system according to claim 1, further comprising a first stopping device arranged on the first carrying strap above the first portion of the connecting device and a second stopping device arranged on the second carrying strap above the second portion of the connecting device.

9. The carrying system according to claim 8, wherein the first stopping device is located between a first cover and the first portion of the connecting device and the second stopping device is located between a second cover and the second portion of the connecting device.

10. The carrying system according to claim 1, further comprising at least one of a third stopping device arranged on the first carrying strap below the first portion of the connecting device and a fourth stopping device arranged on the second carrying strap below the second portion of the connecting device.

11. The carrying system according to claim 1, further comprising the first tightening device arranged on the first carrying strap, between the first portion of the connecting device and the first position of the lower section of the load receptive unit and the second tightening device arranged on the second carrying strap, between the second portion of the connecting device and the second portion of the lower section of the load receptive unit.

12. The carrying system according to claim 1, wherein the first and second carrying straps are each made in one piece.

13. The carrying system according to claim 1, wherein the connector opening includes a key hole shape with the lower portion and the upper portion, wherein the connector protrusion includes the first part corresponding to the lower portion of the key hole shape and the second part corresponding to the upper section of the key hole shape.

14. The carrying system according to claim 13, wherein the first and second carrying straps respectively run through first and second covers, the first and second stopping devices, the first and second portions of the connecting device and the first and second tightening devices.

15. The carrying system according to claim 1, wherein the first and second portions of the connecting device are connected to each other by a connector or a combination of connectors taken from a group comprising: magnets, hook-and-loop fastening strip, key hole fasteners, hook-and-loop fasteners, cuff link fastening, sliding fasteners, and snap fastener.

16. The carrying system according to claim 1, wherein the connecting device is made of plastic, metal, rubber, or any combination thereof.

17. The carrying system according to claim 1, wherein the system is configured to form a backpack.

18. The carrying system according to claim 1, wherein the system is configured for a craftsman.

19. A method for attaching a carrying system, comprising:

providing a carrying system having first and second carrying straps, at least one stopping device, a tightening device, and a connecting device with first and second portions, the first portion having a connector opening and a first passage about a first passage axis arranged along a first strap axis of the first carrying strap, the second portion having a connector protrusion and a second passage about a second passage axis arranged along a second strap axis of the second carrying strap, wherein a first part of the connector protrusion is inserted into a lower portion of the connector opening and a second part of the connector protrusion is pushed substantially parallel to the first passage axis and upwards with respect to an upper portion of the opening to lock the first part of the connector protrusion relative to the first portion of the connecting device, and wherein the first and second passage axes are substantially parallel to the respective first and second strap axes;

placing the carrying system on the shoulders of a user;

adjusting the position of first and second portions of the connecting device with the at least one stopping device;

connecting the first and second portions of the connecting device; and tightening the first and second carrying straps with a tightening device.

20. A method for attaching a carrying system, comprising:

providing a carrying system having first and second carrying straps, first and second stopping devices, a tightening device, and a connecting device with first and second portions, the first portion having a connector opening and a first passage about a first passage axis arranged along a first strap axis of the first carrying strap, the second portion having a connector protrusion and a second passage about a second passage axis arranged along a second strap axis of the second carrying strap, wherein a first part of the connector protrusion is inserted into a lower portion of the connector opening and a second part of the connector protrusion is pushed substantially parallel to the first passage axis and upwards with respect to an upper portion of the opening to lock the first part of the connector protrusion relative to the first portion of the connecting device, and wherein the first and second passage axes are substantially parallel to the respective first and second strap axes;

placing the carrying system on the shoulders of a user;

adjusting the position of the first and second stopping devices;

adjusting the position of the first and second portions of the connecting device;

connecting the first and second portions of the connecting device; and tightening the first and second carrying straps with the tightening device.

21. The carrying system according to claim 1, wherein a protrusion axis of the connector protrusion is substantially transverse to the first passage axis of the first passage when the connector protrusion is attached to the connector opening.

22. The carrying system according to claim 1, wherein connector opening includes a recess configured to slideably receive the connector protrusion along a recess axis that is substantially parallel to the first passage axis of the first passage.

23. The carrying system according to claim 1, wherein at least one of the first and second carrying straps includes a rope.

* * * * *